US006547370B2

(12) United States Patent
Mantell et al.

(10) Patent No.: US 6,547,370 B2
(45) Date of Patent: Apr. 15, 2003

(54) METHOD OF PRINTING INCLUDING STITCHING AND INTERPOLATING

(75) Inventors: David A. Mantell, Rochester, NY (US); Thomas N. Taylor, Rochester, NY (US); Doron Kletter, San Mateo, CA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/808,691

(22) Filed: Mar. 14, 2001

(65) Prior Publication Data

US 2002/0130914 A1 Sep. 19, 2002

(51) Int. Cl.[7] ..... B41J 2/145

(52) U.S. Cl. ..... 347/41; 347/16; 347/42; 347/12

(58) Field of Search ..... 347/41, 42, 12, 347/16, 179, 43, 14, 13, 40, 15

(56) References Cited

U.S. PATENT DOCUMENTS 4,661,859 A * 4/1987 Mailloux et al. ..... 358/283
5,384,587 A * 1/1995 Takagi et al. ..... 347/41
5,777,576 A * 7/1998 Zur et al. ..... 347/120
5,777,641 A * 7/1998 Suzuki et al. ..... 347/15
5,784,090 A * 7/1998 Selensky et al. ..... 347/102
6,069,709 A * 5/2000 Harrington ..... 358/1.8
6,336,701 B1 * 1/2002 Hickman ..... 347/37

* cited by examiner

*Primary Examiner*—John Barlow
*Assistant Examiner*—Lam Nguyen
(74) *Attorney, Agent, or Firm*—Fay, Sharpe, Fagan, Minnich & McKee, LLP

(57) ABSTRACT

A method for printing in an image forming system is disclosed. The method, in combination with an apparatus printhead, suppresses defects in printed images. When an image forming system prints an image or group of images in a swath by swath manner, there is a tendency for minor printing defects to arise based on poor alignment of the printhead or ink ejectors, or an error in the instruction software. The printing defects can be defects such as unwanted white spaces or lines, or unwanted bold areas or overlapping swath edges. The present invention utilizes the edges of the swaths to insert a stitch line between the swaths having a different number and size of pixels printed, to allow for modification of the stitch line after measuring an actual advance of a printing medium between each instance of a swath. The same image data line provides the instructions to print both the first and second portions of the stitch line, between each swath.

17 Claims, 5 Drawing Sheets

METHOD OF PRINTING INCLUDING STITCHING AND INTERPOLATING

FIELD OF THE INVENTION

The invention relates to image forming systems, and more particularly relates to suppressing visual defects associated with multiple swath printing.

BACKGROUND OF THE INVENTION

There are a number of different image forming systems in use today for generating images on a print medium. One such image forming system is an Acoustic Ink Printing (AIP) system. The AIP system employs focused acoustic energy to eject droplets of ink from a printhead onto a printing medium. Printheads utilized in AIP systems most often include a plurality of droplet ejectors, each of which emits a converging acoustic beam into a pool of fluid, such as ink. The converging acoustic beam focuses at the border between the ink and the air. The modulation of the radiation pressure exerted by the beam of each print ejector against the surface of the ink selectively ejects droplets of ink from the surface. Different combinations and quantities of inks and ink droplets can combine to achieve a wide variety of colors and shades demanded for the creation of documents.

Different inks and ink droplets combine in AIP, and other systems, to form a series of printing swaths, which proceed across a printing medium to form a desired document image. The alignment of abutting regions of the printing swaths has an impact on print quality. Such regions can occur in either reciprocating carriage printers when the printhead is advanced, or from the alignment of the boundary between two same-color printheads. The alignment problem compounds for multiple small-drop printing as found in AIP systems. Swath alignment defects in printed images take the form of horizontal edges, which are particularly noticeable.

One approach includes a system in which the ends of the swaths are randomly placed as disclosed in a separate application entitled "A METHOD AND APPARATUS FOR STITCHING PRINT SWATHS IN AN IMAGE-RENDERING DEVICE" by Ellson, et al., filed Dec. 18, 2000 with the USPTO (application Ser. No. 09/739,854) hereby incorporated herein by reference. The teachings of the present invention can adjust the ends of the offset rows in the manner disclosed below.

Another known approach is to provide no form of stitching at the swath boundaries. The approach works well if the advance between swaths is small and fairly accurate. Small advances can be done quickly, accurately, and any defects will occur at a higher frequency. However, when larger advances are needed as in the case of high speed printing with large printheads, or swaths are printed by separate printheads or elements, accurate and efficient placement of the swaths is difficult.

SUMMARY OF THE INVENTION

There exists in the art, for the foregoing reasons, a need for a method of printing in an image forming system that suppresses defects in the printed images. The present invention is directed toward further solutions in this art.

An image forming system in accordance with one example embodiment of the present invention includes a method for printing on a printing medium, such as, e.g., a paper sheet. The method includes the steps of determining a collection of image data lines representing an image to be printed. Each image data line contains data for printing the line, in predetermined line increments. The image forming system then prints a first swath comprised of a collection of data lines, the specific number depending at least partially on the width of the swath. The first swath includes a first portion of a stitch line that disposed along one edge of the first swath. The edge, for illustrative purposes, is typically a bottom most edge of the swath on the printing medium, or the last data line printed in the swath. The printing medium advances, after completion of the first swath, a predetermined distance to prepare for the printing of an additional swath. The image forming system prints a second swath, which includes a second portion of the stitch line disposed along one edge of the second swath. The edge of the second swath is typically the upper most edge of the swath, or the first data line printed. The same image data line provides the instructions to print both the first and second portions of the stitch line, between each swath.

The method, according to one aspect of the invention, further includes the step of measuring the amount of advance subsequent to each advancing step. The middle portion of printhead ejectors are used for printing for an accurate advance. The outer ejectors are reserved for occasional use to reach distal edges of a swath to correct for large errors in the swath advance. In the case of a large advance error, the swath is printed with ejectors that lie nearest to the intended pixel locations of the swath. This has the effect of limiting the effective advance error to half the pixel resolution.

The method, according to another aspect of the invention, further includes the step factoring the measurement values into the further calculation of the number of drops used in the second portion of the stitch line printed in the second swath.

The first portion of the stitch line, according to yet another aspect of the present invention, ranges between 0 and 100% of the final stitch line. The second portion of the stitch line, in such an instance, prints in an amount of 100% minus the percentage printed in the first portion of the stitch line. The varying percentage portions of the stitch line printed in each of the first and second swaths compensate for advance defects.

The step of printing the first swath includes printing a first portion of the stitch line representing 50% of the stitch line according to still another aspect of the present invention. The second portion of the stitch line, printed in the second swath, then comprises between 0 and 100% of a nominal definition of the stitch line.

A similar procedure is used for printing with multiple printheads or elements, except in such a case the alignment of the printheads is measured in advance. The actual alignment at the time of printing can vary in ways that can be predicted. One variable that can affect the alignment is temperature. If alignment error is known prior to printing either swath, there is greater flexibility in the determination of the percentage of drops printed for each portion of the stitch. The result is a greater range in the amount of ink that can be deposited from a minimum of 0% to a maximum of 200% totaled between the two stitch portions.

BRIEF DESCRIPTION OF THE DRAWINGS

The aforementioned features and advantages, and other features and aspects of the present invention, will become better understood with regard to the following description and accompanying drawings, wherein.

DETAILED DESCRIPTION OF THE INVENTION

Figure 1:
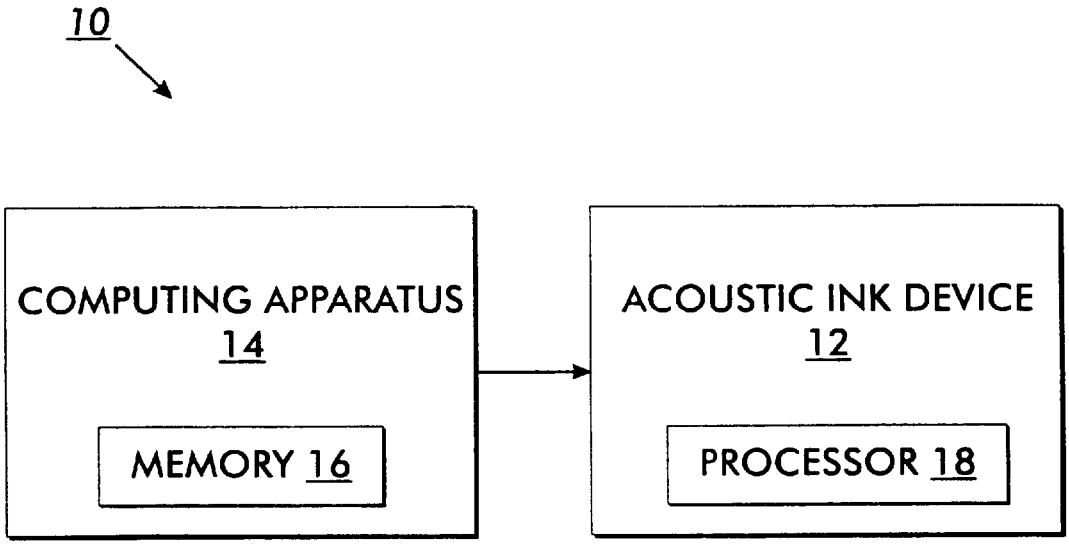
FIG. 1 is a diagrammatic illustration of an acoustic ink printing system according to one aspect of the present invention.

The present invention relates to image forming systems in general. There are a number of different image forming systems in use today for generating images on a print medium. Such image forming systems include a collection of different technology characterizations, such as, electrostatic, electrostatographic, ionographic, acoustic, laser, peizo, ink jet, and other types of image forming or reproducing systems adapted to capture and/or store image data associated with a particular object, such as a document, and reproduce, form, or produce an image.

An acoustic ink printing system (AIP system) will be discussed herein for ease of illustration, but is by no means intended to limit the invention solely to acoustic ink printing. The applicable rules of law, and the appended claims, are all that limit the present invention, and the teachings thereof. The description and accompanying drawings are merely examples illustrating the inventive concept herein. Other types of image forming systems that form images utilizing ink, electric charges, or the like, in a like manner to an AIP system, can also utilize the teachings of the present invention to improve print quality.

The method and system of the image forming system of the invention receives or generates a collection of image data lines representing an image to be printed. The system then proceeds to print the image in a series or collection of swaths. A plurality of image data lines provides the information for the printing of each swath of the image or images on a printing medium. The alignment of abutting regions of the printed swaths impacts print quality. If there is a misalignment of swaths, or of different colored inks within a swath, defects ranging from white-space to heavy or bolded lines or sections can result. The alignment problem compounds for multiple small-drop printing as in AIP systems. The method of the present invention suppresses these defects. One ejector of a printhead overlaps the regions between multiple printheads in accordance with one aspect of the present invention. The AIP system renders the image to ink drops. The AIP system advances the printed sheet after the completion of each swath. If such advancement is perfect, a stitch pattern located along each edge of each swath divides roughly equally between two adjoining swaths. The AIP system measures the actual resulting advance or alignment of the printed sheet, and any defects thereof. An advance defect is the result of a defective advance where the actual amount of advance is different from the amount of advance instructed. If the advance is not perfect, or substantially perfect within predetermined ranges, the AIP system can shift data sent to the printhead for the ejectors closest to the intended location, and in addition can add or subtract drops from at least one of the stitch line regions. The modification of drops occurs where appropriate to compensate for printhead placement and other alignment errors.

FIGS. 1 through 8, wherein like parts are designated by like reference numerals throughout, illustrate an example embodiment of an acoustic ink printing system 10 according to the teachings of the present invention. Although the present invention will be described with reference to the example embodiments illustrated in the figures, it should be understood that the present invention can be embodied in many alternative forms. One of ordinary skill in the art will additionally appreciate different ways to alter the parameters of the embodiments disclosed, such as the size, shape, or type of elements or materials, in a manner still in keeping with the spirit and scope of the present invention.

FIG. 1 illustrates an image forming system in the form of an acoustic ink printing system 10 for printing an image, or selection of images. The system includes an acoustic ink printing (AIP) device 12 and a computing apparatus 14. The phrase "computing apparatus" as utilized herein refers to a programmable device that responds to a specific set of instructions in a well-defined manner, and can execute a set of instructions. The computing apparatus can include one or more of a storage device, which enables the computing apparatus to store, at least temporarily, data, information, and programs (e.g., RAM or ROM); a mass storage device for substantially permanently storing data, information, and programs (e.g., disk drive or tape drive); an input device through which data and instructions enter the computing apparatus (e.g., keyboard, mouse, or stylus); an output device to display or produce results of computing actions (e.g., display screen, printer, or infrared or digital port); and a central processing unit including a processor for executing the specific set of instructions.

The computing apparatus 14 forms an image by transmitting the image data from the memory 16 to the AIP device 12. The transmission occurs through a link 15, which can be comprised of an electric cable, fiberoptic cable, or other wireless transmission arrangement such as infrared or RF signal. A processor 18 processes the image to be printed.

The result of this arrangement is that a desired image enters the AIP system to be printed. The AIP system renders the image to a collection of image data lines and translates those image data lines to a printing medium in the form of a printed image. The actual printing process in an AIP system occurs with a swath by swath deposit of ink on the printing medium, and the advancement of the printing medium between the completion of each swath.

Figure 2:
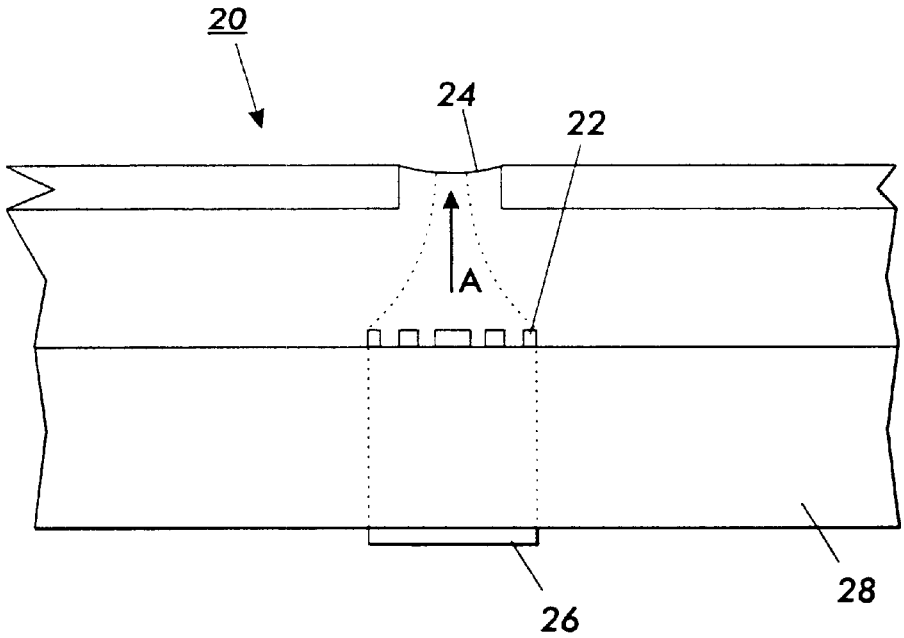
FIG. 2 is a schematic illustration of an acoustic ink printhead according to one aspect of the present invention.
Figure 3:
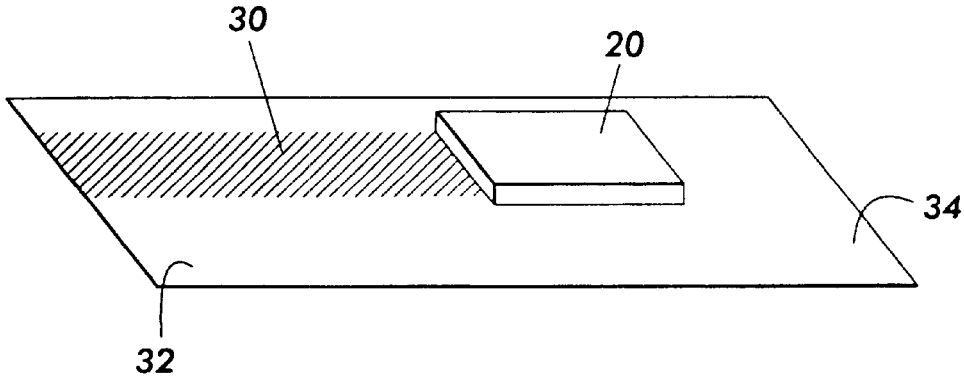
FIG. 3 is a perspective view of an acoustic ink printhead over a printing medium according to one aspect of the present invention.

FIG. 2 illustrates an AIP printhead 20. The AIP printhead 20 includes acoustic lenses 22 for ejecting fluid, such as ink, from associated ink ejectors 24. The signals sent to the acoustic generators 22 originate with the transducers 26, and pass the spacer 28 enroute to the acoustic generators 22. The AIP printhead 20 moves across respective swaths 30 and 32 of the printing medium 34 as illustrated in FIG. 3 during a printing process. The printhead 20 can move across the printing medium 34 along the swath 30. The AIP device 12 advances the printing medium 34 once the swath 30 is complete, enabling the printhead 20 to move across the swath 32 as it forms an image on the printing medium 34.

FIG. 3 illustrates an example embodiment of an AIP printhead 20 traveling across swaths 30 and 32 of the printing medium 34. Each of the swaths 30 and 32 is approximately two inches in width in this example embodiment, however the dimensions of the swaths are variable depending on the particular image forming system. The AIP printhead 20 ejects droplets of ink during each pass, producing the desired image on the printing medium 34. Multiple printheads can alternatively be packaged together to form a substantially wider printhead, which allows for fewer printhead passes to form wider swaths and complete an image in fewer passes and less time. Each printhead 20 typically ejects between 1 and 10 ink droplets from each ink ejector 24 in a corresponding high-resolution pixel on the printing medium 34 during each printhead pass, however the number of ink droplets deposited per pixel can vary. The teachings of the present invention encompass such variations in ink droplet numbers.

Figure 4:
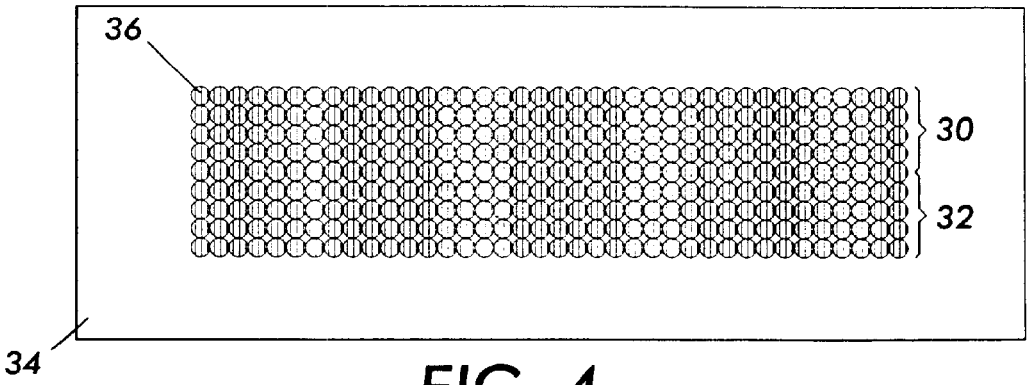
FIG. 4 is an illustration of a printed sheet having a collection of swaths in perfect alignment.

FIG. 4 illustrates a collection of individual pixels 36 printed in two individual swaths 30 and 32. There is no distortion of the image formed by each of the pixels 36 in this illustration. The image contains three hundred eight (308) pixels 36, each full pixel represented by a circle. The image has eight (8) rows of thirty-eight (38) pixels 36. There are no anomalies, unwanted white-spaces, or unwanted overlapping pixels or bolded areas. The image is a basic rectangle. The farther a person stands from the image, the less perceptible are the individual pixels 36, and the more solid and filled-in the image becomes. This illustration of pixels 36, in other words, represents an ideal final image of a basic rectangle drawn by a properly aligned printhead on a properly advanced printing medium 34.

Figure 5:
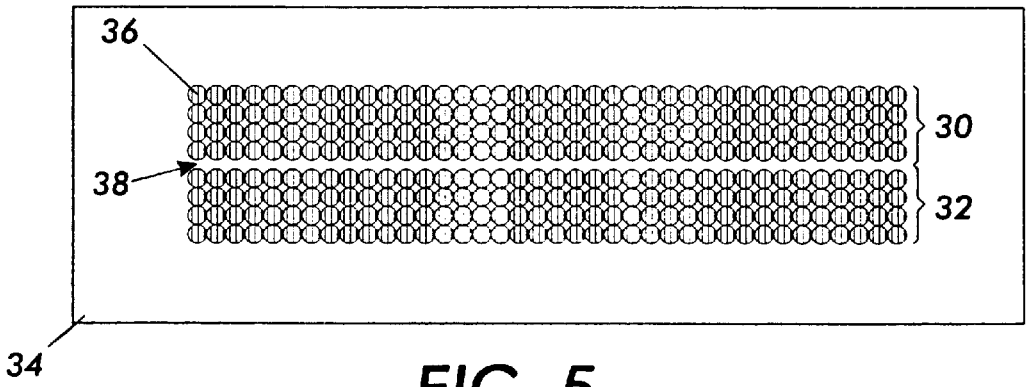
FIG. 5 is an illustration of a printed sheet having two swaths separated by a gap.

FIG. 5, in contrast, illustrates one of the problems solved by the teachings of the present invention. There is a collection of pixels 36, which have been printed in swaths 30 and 32 on the printing medium 34. The AIP system 10 in this instance, however, is misaligned or the printing medium 34 over-advanced and the resulting position of the swaths 30 and 32 includes a gap 38 therebetween. This gap 38 illustrates a likely result, for example, when the AIP system 10 advances the printing medium 34 a greater distance than instructed by the computing apparatus 14 and/or the processor 18 of the AIP system 10. The AIP system 10 instructs the advancement of the printing medium 34 a predetermined distance, and during the execution of the advancement, some misalignment, physical defect or abnormality, or software error, causes the actual advancement of the printing medium 34 to be greater than the predetermined instructed advancement. The second swath 32, in this instance, prints at a greater distance from the first swath 30 than instructed, and forms the white-space gap 38. This gap 38 can be seen by a user as a thin white line streaking through the desired print image. If the user views the image of FIG. 5, approximately the same distance as necessary for the image of FIG. 4 to be perceived as a solid rectangle, a thin white line can be seen extending through the rectangle image at the white-space gap 38. This gap 38, although significantly enlarged in FIG. 5 for illustrative purposes, mimics the same effect that occurs on a smaller scale in high-resolution printing defects in printed images.

Figure 6:
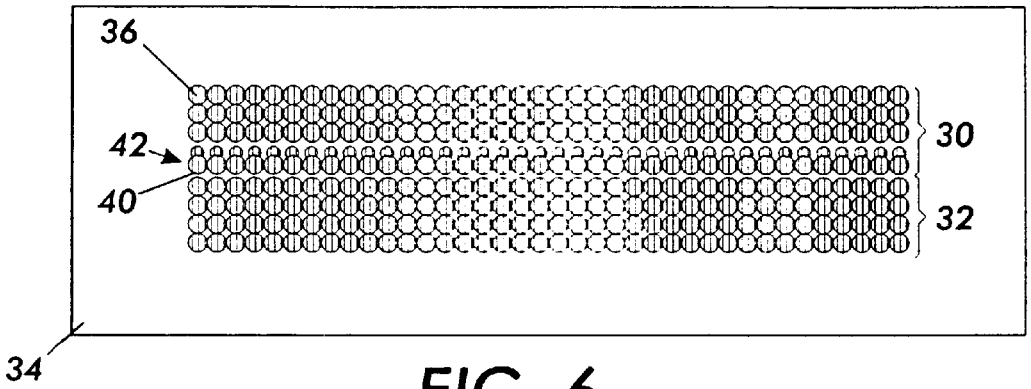
FIG. 6 is an illustration of the two swaths of FIG. 5 with the addition of stitch lines according to one embodiment of the present invention.

FIG. 6 illustrates a solution of the problem of FIG. 5, according to the teachings of the present invention. The collection of pixels 36 is shown in two swath paths, swaths 30 and 32. The actual advancement of the printing medium in the illustrated scenario is once again greater than instructed or desired, thus a gap 38 exists between swath 30 and swath 32. However, the method according to the teachings of the present invention inserts partial pixels 40 in the region of the gap 38 between the swath 30 and the swath 32. The partial pixels 40 are selected percentages of the size of the original pixels 36, and a single ejector 24 of the printhead forms the partial pixels 40. These additional partial pixels 40 forming one or more rows are referred to as a stitch line 42, and extend along an edge of the first swath 30 and an edge of the second swath 32.

Figure 7:
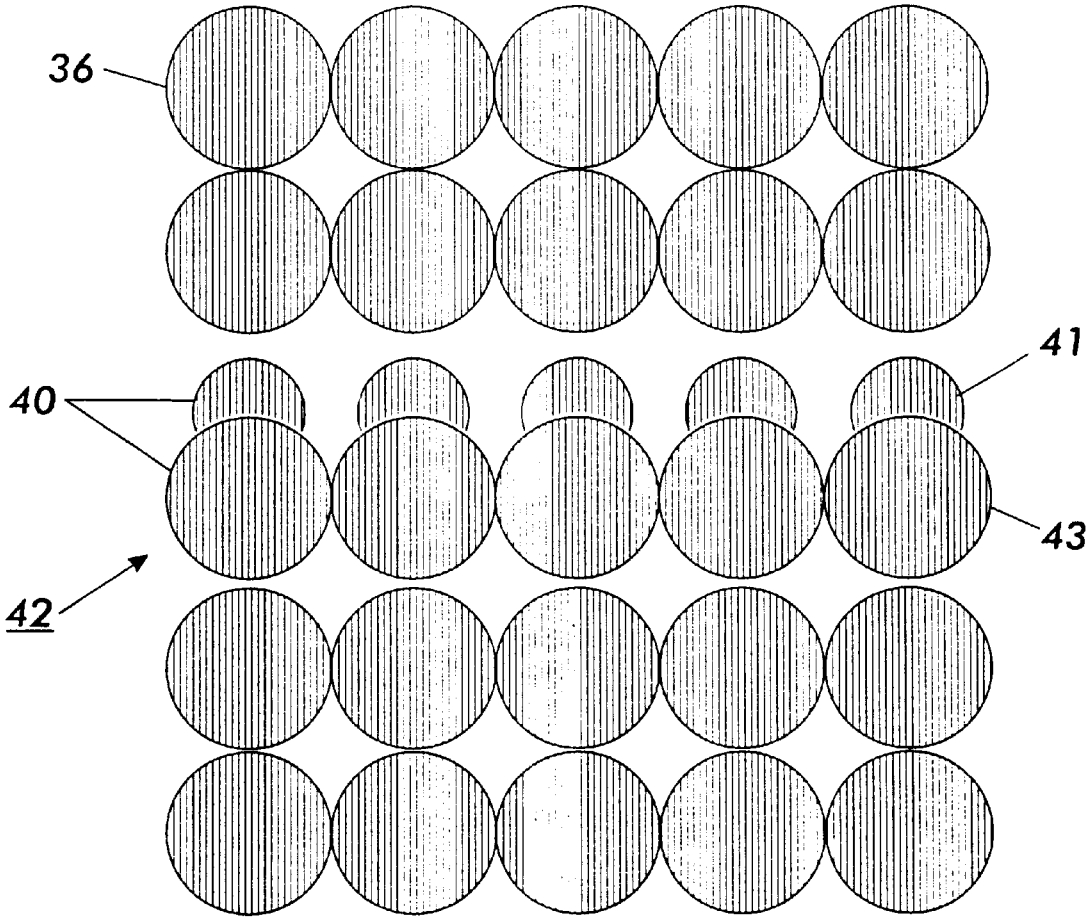
FIG. 7 is an illustration of an enlarged portion of the swaths of FIG. 6.

FIG. 7 is an enlarged section of the stitch line 42 of FIG. 6. The original pixels 36 have a gap between them filled by the stitch line 42. The stitch line 42 is made up of the partial pixels 40. More specifically, there is a first row of partial pixels 41 and a second row of partial pixels 43. The first row of partial pixels 41, shown in grayscale, are approximately 50% of the drop volume of an original pixel 36. The partial pixels 43, are approximately 90% of the drop volume of an original pixel 36 and fill the remaining space of the gap 38. A plurality of drops of a predetermined number, to reiterate, compose each pixel 36 and a plurality of drops of a lesser predetermined number compose the partial pixels 40 (further illustrated as partial pixels 41 and 43). The size of each individual drop does not change, but the number of drops, and consequently the size of the pixels 36, does change.

When trying to print a 100% solid image, the partial pixels 40, according to one aspect of the present invention, average approximately 50% of the total drop volume of a full pixel 36 along the edge of the first swath 30. The partial pixels 40 along the edge of the second swath 32 range anywhere between 0% and 100% of the drop volume of a full pixel 36. The partial pixels 40 illustrated in FIGS. 6 and 7 along the edge of the second swath 32 are a greater percentage drop volume of a full pixel 36 than the partial pixels 40 along the edge of the first swath 30. Thus, there is some overlap between the two rows of partial pixels 40 to fill in the gap 38 of FIG. 5. Those of ordinary skill in the art will readily recognize that the pixels disposed along the edges of the first and second swaths can be sized differently to achieve the results of the present invention. Likewise, the partial pixels 40 along the edge of the first swath 30 can be other than 50% of the drop volume of a full pixel and in different number, and the partial pixels 40 along the edge of the second swath 32 adjusted accordingly.

The partial pixels 40 in the stitch line 42 fill in the visual gap 38 formed between the first swath 30 and the second swath 32. This substantially suppresses the previous printing defect of a white line through the printing image. If the second swath 32 overlaps with the first swath 30, the partial pixels 40 can alternatively be printed in fewer numbers and in a smaller size percentage to prevent a bolder, thicker line from otherwise appearing in the overlap of the first swath 30 and the second swath 32. The drops printed on the last line of the first swath 30 are approximately 50% of the drops call for that line of the image. The first line printed with the second swath 32 is larger than the last line of the first swath 30 to compensate for a gap.

Figure 8:
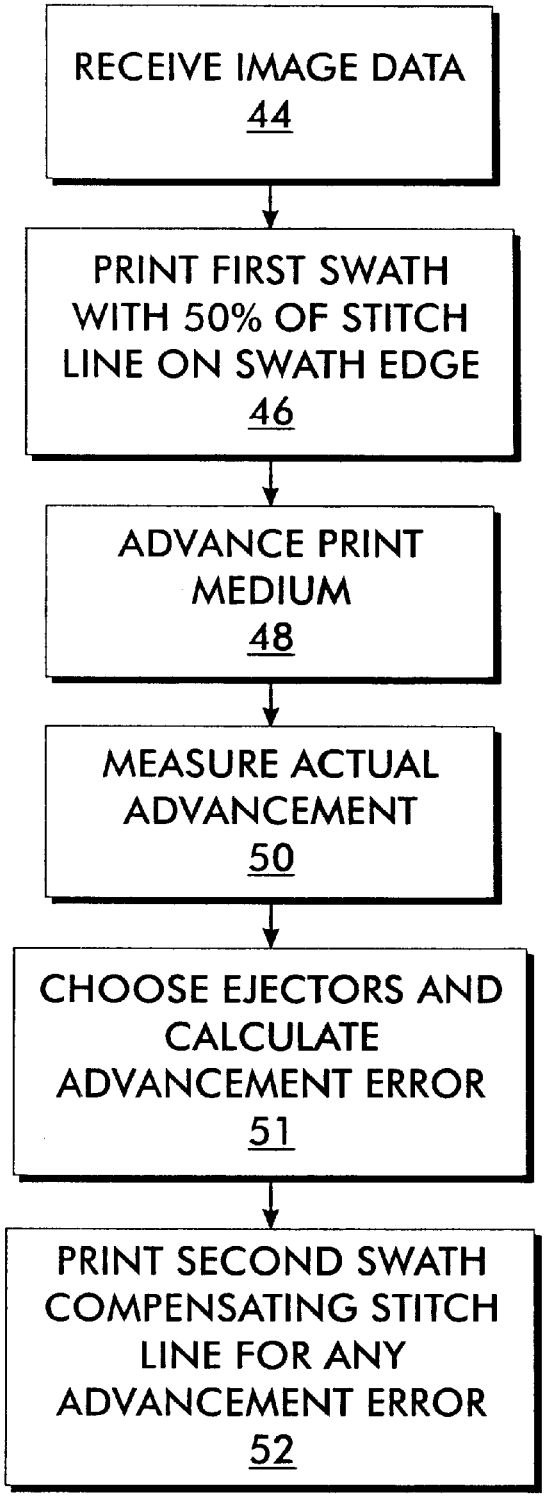
FIG. 8 is a flow chart illustrating a method of printing according to one aspect of the present invention.

FIG. 8 illustrates a flow chart showing the method according to the teachings of the prevent invention. The image forming system first intakes the image data in step 44. The image forming system prints the first swath with 50% of the stitch line 42 extending along a bottom edge of the swath 30 (step 46). The stitch line 42 is partially formed by the last line of the first swath 30 and partially formed by the first line of the second swath 32.

Each portion of the stitch line 42 approximately corresponds physically on the printing medium 34 because the last line of the first swath 30 and the first line of the second swath 32 originate from the same line of image data. The proportions of the pixel drops are split between each swath 30 and 32 in a manner in accordance with the teachings of the present invention. The stitch line 42 nominally splits the drops equally between the first swath 30 and the second swath 32. The stitch line 42 utilizes very small patterns to dither odd drops. Specifically in this example, half of the drops print with the first swath 30, and a variable number of drops print with the second swath 32 after measuring the actual advance of the printing medium.

To proceed with the methodology, the printing medium advances after the completion of the first swath 30 in step 48. The image forming system measures the actual advance of the print medium in step 50. The image forming system, from the measurement of the actual advance and any corresponding advance error, chooses ejectors near intended pixel locations and calculates the residual error and uses that calculation to determine the size and location for the pixels of the second swath (step 51). The image forming system then prints the second swath 32, compensating the stitch line 42 for any advancement error (step 52). If the actual advance matches up substantially with the desired advance, such an occurrence is accurate enough that the second swath 30 will include 50% of the stitch line 42 complementing the original 50% portion of the stitch line 42 from the first swath 30.

The number of drops for the overlapping stitches in the second swath 32 varies for multiple swath printing. The first swath in the example embodiment does not vary from 50% because it is printed prior to knowing of any stitch advance error. The number of drops for the overlapping stitch lines of either or both swaths can vary in the case of overlapping printing between two or more printheads.

The number of drops for the stitch line 42 of the second swath 32 is chosen from a limited set according to one example methodology of the present invention. The increment of the number of drops is 25% for discussion purposes in this illustration. This means that the image forming system can print the nominal 50% of the drops in the first swath 30 stitch line and some variation such as, 0%, 25%, 50%, 75%, or 100%, in the stitch line 42 of the second swath 32. This provides potential total ink volumes of 50%, 75%, 100%, 125%, or 150% of the nominal of the number of drops respectively. If a fixed number of options are chosen, then the drops needed for the second pass can be calculated prior to the advance and the correct choice inserted subsequent to the measurement. Alternatively, a small number of options allow the drops to be chosen by very small halftone patterns, which can be implemented quickly subsequent to an advance. For example, for a uniform image of one drop everywhere as in the above example, a halftone pattern with dimensions as small as 1×4 can be used. This insures that for 25%, only every fourth drop is printed. For 50%, two out of each four drops are printed, for 75% three out of every four drops are printed, for 0% none of the drops are printed, and for 100% all of the drops are printed. The conjugate of the halftone pattern used for the first pass can be used for the second pass. Thus, for a perfect advance, each pass contains two drops out of the 4 (50%) but they are the opposite two drops. This results in each pixel of the final image containing only one drop. Larger halftone patterns can be used to provide more complicated filling patterns.

The patterns of the odd drops to approximate 25%, 50%, 75% of the drops are chosen such that they do not correlate with the method used to render the image to drops in a first instance. Odd drops are distributed by halftoning the pattern on the first pass. On the second pass a conjugate pattern can be used. For a perfect advance, the first halftoning chooses a percentage, typically 50%, of the drops for the first pass over the stitch line, and the second halftoning chooses the remaining drops. Typically the halftone pattern is kept small for speed of calculation. Care is taken in designing the halftone patterns to insure that they do not correlate with the method used to render the image from graylevels to drops.

In cases where the stitch line is not straight because only one pixel at the end of the stitch is split between passes, a one dimensional halftone pattern is sufficient. See for example, "A METHOD AND APPARATUS FOR STITCHING PRINT SWATHS IN AN IMAGE-RENDERING DEVICE" by Ellson, et al. Id. mentioned earlier, for an example of a non-linear stitch that can be enhanced by the teachings of the present invention.

Other methods can be used to choose the drops, such as one-dimensional error diffusion or using a strict alternating method between passes. In such cases, the percentage of drops required between the two passes can be accurately reproduced to the desired percentages, rather than only approximated as they are with halftoning.

The present invention includes many features and advantages. Choosing ejectors near the desired pixel location can compensate for large advance errors. The single ejector width overlap between swaths allows fine adjustment for advance and or alignment inaccuracies over the previous method of having no overlap. Large overlaps reduce the swath size and can create visible artifacts due to positional errors between the printing of the two swaths. The additional use of partial pixels to fill in the gap further increases the effectiveness of the present invention, as well as the previous solution, and gives great flexibility of between 50% and 150% of a normal pixel row weight to correct any printing defects. The use of the partial pixels softens the stitch line within the gap, resulting in a more subtle, effective, and exact visual correction of any defects ranging from white-space to overlapping or bold anomalies. These features and advantages are in addition to others not specifically detailed herein but observed by those of ordinary skill in the art.

While the stitching has been described in terms of swath advances of a single printhead, the teachings of the present invention can also be used to stitch between multiple print elements. The primary difference is that the positioning of the printheads with respect to each other can be known or calibrated ahead of time. Thus, it is not a requirement that the one of the stitches use 50% of the drops called for in the image. It is possible to use 50% of the drops desired after stitch. In this manner, each of the stitch lines can be adjusted between 0% and 100%, providing a greater range of compensation. In this manner, the alignment tolerance of individual print elements is relaxed even further than that of the dynamic advance of a single printhead.

Numerous modifications and alternative embodiments of the invention will be apparent to those skilled in the art in view of the foregoing description. Accordingly, this description is to be construed as illustrative only and is for the purpose of teaching those skilled in the art the best mode for carrying out the invention. Details of the structure may vary substantially without departing from the spirit of the invention, and exclusive use of all modifications that come within the scope of the appended claims is reserved. It is intended that the invention be limited only to the extent required by the appended claims and the applicable rules of law.

What is claimed is:

1. In an image forming system, a method for printing a plurality of image data lines on a printing medium, the method comprising:

printing a first swath including a first portion of a stitch line disposed along one edge of said first swath;

advancing said printing medium according to a predetermined distance;

measuring an actual advance of said printing medium;

selecting at least one aspect of a second portion of said stitch line based on the actual advance measurement; and printing a second swath including the second portion of said stitch line, according to the selected at least one aspect, disposed along one edge of said second swath.

2. The method according to claim 1, wherein selecting at least one aspect of said second portion of said stitch line, comprises selecting ejectors of said printhead for printing said second portion of said stitch line closest to intended pixel locations associated with the predetermined distance.

3. The method according to claim 1, wherein selecting at least one aspect of said second portion of said stitch line comprises selecting a coefficient for adjusting the number of drops used in said second portion of said stitch line printed in said second swath.

4. The method according to claim 3, wherein selecting a coefficient comprises selecting a coefficient in the range of between about zero and one hundred, percent, adjusted to compensate for said advance defect.

5. The method according to claim 4, further comprising printing one or more lines of image data in said first and second portions of said stitch line.

6. The method according to claim 5, wherein printing a first swath comprises printing about fifty percent of said stitch line in said first portion of said stitch line.

7. The method according to claim 6, wherein printing a second swath comprises printing between about zero and one hundred percent of said stitch line in said second portion of said stitch line.

8. The method according to claim 6, wherein a finite number N of percentages are predetermined.

9. The method according to claim 8, wherein a pattern of drops for said second portion of said stitch line is predetermined for each of said N percentages prior to completion of the measurement.

10. The method according to claim 8, wherein the drops are chosen for said stitch line on each pass by halftoning.

11. The method according to claim 10, wherein halftone patterns for the two passes are conjugate.

12. The method according to claim 10, wherein halftone patterns are one-dimensional.

13. The method of claim 12, wherein a size of said patterns is chosen to not correlate with frequencies of drops generated by the method used to render the original image.

14. The method according to claim 2, wherein there is a sufficient number of unused ejectors to account for accumulated errors from multiple swaths.

15. The method according to claim 14, wherein the predetermined distance for a subsequent advance is modified in order to compensate for error accumulated from previous advances.

16. The method according to claim 1, wherein a selected percentage of pixels are printed in said first portion of said stitch line and a remaining percentage of pixels, based at least partially on said percentage in said first portion printed, and at least partially on an advance amount, are printed in said second portion of said stitch line.

17. The method according to claim 1, wherein printing said second swath, including said second portion of said stitch line, comprises printing between zero and one hundred percent of a nominal definition of said stitch line.

* * * * *